United States Patent [19]

Pappert et al.

[11] 4,223,047

[45] Sep. 16, 1980

[54] METHOD OF DEPOSITING A PROTECTIVE SURFACE LAYER ON A VERY THIN METAL SHEET

[75] Inventors: Werner Pappert; Ulrich Tenhaven; Friedrich Wolff, all of Dortmund, Fed. Rep. of Germany

[73] Assignee: Hoesch Werke Aktiengesellschaft, Dortmund, Fed. Rep. of Germany

[21] Appl. No.: 923,781

[22] Filed: Jul. 12, 1978

[30] Foreign Application Priority Data

Jul. 15, 1977 [DE] Fed. Rep. of Germany ..... 2732009

[51] Int. Cl.[2] ..... B05D 3/06

[52] U.S. Cl. ..... 427/32; 252/390

[58] Field of Search ..... 427/32; 252/390

[56] References Cited

U.S. PATENT DOCUMENTS

| | | | |
|---|---|---|---|
| 2,790,779 | 4/1957 | Spivack et al. | 252/392 |
| 2,884,338 | 4/1959 | Jenison | 427/32 |
| 3,726,701 | 4/1973 | Nishikawa et al. | 427/32 |
| 3,787,227 | 1/1974 | Marans | 427/379 |

FOREIGN PATENT DOCUMENTS 98105 3/1972 German Democratic Rep. .

*Primary Examiner*—John H. Newsome

*Attorney, Agent, or Firm*—Becker & Becker, Inc.

[57] ABSTRACT

A method of depositing an oil containing protective surface layer on a very thin metal sheet preferably intended for packing purposes. The very thin metal sheet, in the form of a band and at a band speed of up to 600 m/min, is electrostatically coated with a mixture comprising 1 to 2 parts of an ester of sebacic acid, azelaic acid, or citric acid, and 1 part of a high molecular monobasic acid having the general formula $CH_3(CH_2)_nCON(CH_3)CH_2COOH$. The coating is formed in a layer of 1 to 10 mg/m$^2$ of surface of the metal sheet.

11 Claims, 1 Drawing Figure

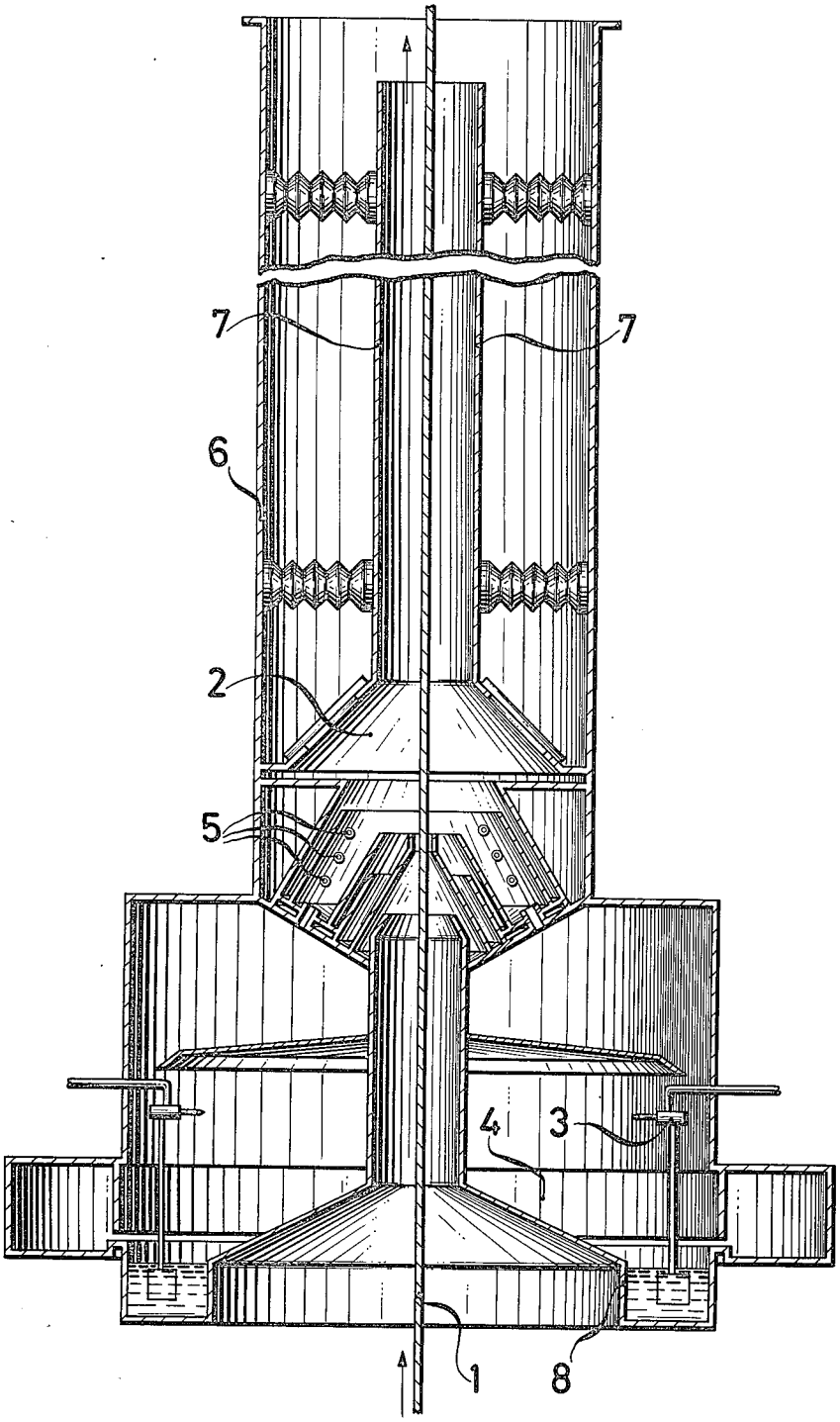
7
7
6
2
5
4
3
1
8

METHOD OF DEPOSITING A PROTECTIVE SURFACE LAYER ON A VERY THIN METAL SHEET

The present invention relates to a method of depositing an oil containing protective surface layer on a very thin metal sheet intended for packing purposes.

Methods of depositing a protective surface layer on metal sheets are known in a variety of forms and with very different protection forming media. With one such known method (German Offenlegungsschrift No. 24 10 854) for producing a cold rolled steel strip or band having thin and very thin sheet thicknesses for manufacturing ironed or deep drawn containers or other deep drawn parts, the band, after being annealed in a continuous-heating furnace, is heat treated with a liquid which simultaneously contains a phosphatizing or phosphating medium and a lubricant. In this connection, subsequent to the annealing, the band is cooled to a temperature between 120° C. and 50° C. The fluid is then placed on the hot band in the form of a thin film, and the band is subsequently wound up into a roll with the still moist liquid film, so that the residual heat stored in the roll is utilized for the chemical phosphating reaction. Although corrosion protection is achieved until further processing by means of the phosphating medium deposited on the band together with the oil used as lubricant, the oil must again be removed if deep drawn parts, for example containers or cans, are to be varnished or printed on.

With another known method (German Auslegeschrift No. 12 99 481) for preventing rusting of the steel surfaces, by using organic layer forming compounds which contain amino groups, at least one aliphatic or alicyclic primary or secondary amine, an alkylimidazole, an alkylglyoxaline, an alkyloxaline, or an alkyloxazole with less than 20 carbon atoms is dissolved in an organic solvent and the solution is continuously deposited on the steel sheet or band at the rate of 0.5 to 5g/203.8 $cm^2$ to form layers after the last pass of the rolled stock through the rolling mill. Rust protection of the steel surface is also achieved with this method between the last step of the manufacture of the sheet and the further processing, for example, plating. Aside from the fact that the substances used are physiologically harmful, the 24.5 to 245 $g/m^2$ which are considered necessary as the thicknesses of the layers, are much too great to allow varnishing of the steel surfaces without first removing these substances prior to the further processing in order to avoid wetting and/or adhesion difficulties.

Another generally known method is based on the fact that a very thin metal sheet in a tin plating line is degreased, scoured, passivated without current in a sodium dichromate solution, and is subsequently oiled with dioctyl sebacate. A variation of this method is based on increasing the passivation in a sodium dichromate bath utilizing direct current, so that heavier chromium oxide/hydroxide layers precipitate on the steel surface. Subsequently, the very thin metal sheet is again oiled with dioctyl sebacate. However, this known method achieves only a very slight corrosion protection which does not suffice for the intended purpose.

Further attempts have been aimed at phosphating and subsequently chromating the very thin metal sheets. In so doing, under certain circumstances an improved varnish adhesion can be achieved, but no sufficient corrosion protection is obtained for the period of transport, storage, and processing.

It is further known (German Ofenlegungsschrift No. 22 51 611) to protect steel surfaces against corrosion by placing an aqueous phosphate solution on the steel surface, drying the band after the reaction of the solution with the steel surface, and subsequently oiling with dioctyl sebacate. Alternatively, the phosphating medium, together with the dioctyl sebacate, can be placed on the band in an aqueous emulsion. After forming the phosphate layer, which requires a reaction time of up to 30 seconds, the steel surface is dried. A drawback to this known method consists in that on the one hand a reaction time for the phosphating medium of up to 30 seconds is required, and on the other hand that additional apparatus is required for drying the steel surface. The drying in turn increases the treatment time of the steel surface, so that the method on the whole is not suitable for rapidly moving band lines.

It is an object of the present invention to present a method of depositing a protective surface layer on very thin metal sheets intended for packing purposes, by means of which corrosion of the metal sheet is prevented between the last step of the manufacture of the sheet and the first step of the further processing. In this connection, this protective surface layer must be deposited quickly in a thin layer on a rapidly moving band. At the same time, the packing sheet which is to be protected against corrosion must, without first having to remove the protective surface layer, be capable of being varnished, welded and slid in processing lines, and must be physiologically harmless.

It is a further object of the present invention that devices which up to now were required for galvanic surface treatment and for drying of the metal sheets be omitted.

These objects and other objects and advantages of the present invention will appear more clearly from the following specification in connection with the accompanying drawing, which shows a preferred embodiment for practicing the method of the present invention.

The single FIGURE illustrates an apparatus for electrostatically spraying the composition of the present invention onto a continuous moving band of metal.

The method pursuant to the present invention for depositing an oil containing protective surface layer on very thin metal sheets intended for packing purposes is characterized primarily in that the very thin metal sheet, in the form of a band and at band speeds of up to 600 m/min, is electrostatically coated with a mixture comprising one to two parts of an ester of sebacic acid, azealic acid, or citric acid, and one part of a high molecular monobasic acid having the general formula $CH_3(CH_2)_nCON(CH_3)\ CH_2\ COOH$, to form a layer having a thickness of 1 to 10 $mg/m^2$ metal sheet surface.

Pursuant to a preferred embodiment of the present invention, the very thin metal sheet is electrostatically coated with a mixture comprising dioctyl sebacate or di(2-ethylhexyl) azelate and, as a further constituent of the mixture, the sarcosine of oleic acid (N-oleoylsarcosine) having a molecular weight of 325 to 355. Pursuant to a further feature of the method of the present invention, it is also possible to form a coating with a mixture of acetyl tributyl citrate and the high molecular monobasic acid having the general formula $CH_3(CH_2)_nCON(CH_3)\ CH_2\ COOH$. With the inventive mixture, one part of each of the two constituents is advantageously used. To apply the mixture to the very thin metal sheet, it has been shown to be advantageous if the metal sheet, in the form of a band, and at a speed of 60 to 360 m/min, is electrostatically coated, and preferably in a layer thickness of 3 to 5 mg/m$^2$ metal sheet surface. A further advantageous feature of the method of the present invention consists in a pre-ionization of the mixture, prior to coating the metal sheet, at a voltage of 2 to 20 KV, preferably 8 to 10 KV, and a precipitation of the pre-ionized mixture on the metal sheet at a voltage of 4 to 40 KV, preferably 35–40 KV. In order to obtain a higher efficiency, it is finally recommended that the mixture be atomized at a pressure of 0.2 to 0.6 bar.

EXAMPLE

A dressed very thin sheet of metal having a thickness of 0.15 to 0.50 mm is, in the form of a band and at a band speed of about 600m/min, guided through an electrostatic oiling device without pretreatment, for example cleaning, to deposit the protective surface layer on the band.

The band 1 is vertically guided from below from a roll (not shown) into a pre-ionization chamber 2, in which the medium which forms the protective layer is ionized. At a voltage of 2 to 20 KV, the medium, which is vaporized in the vaporization chamber 4 by means of primary air from a spray nozzle 3, is pressed into the pre-ionization chamber 2 by means of a secondary air stream. The pressure of the primary air is between 0.2 to 0.6 bar. From the pre-ionization chamber 2, which is provided with ionization wires 5, the finely vaporized medium passes into a flue 6 in which, between precipitator plates 7, the band 1 which is to be coated travels at a speed of up to 600 m/min, preferably 60 to 360 m/min. The precipitation of the protective surface medium between the precipitator plates 7 takes place at a voltage of 4 to 40 KV. The thickness of the layer of protective medium deposited on the bands, after the band has passed through the oiling device for a period of 0.5 to 5 seconds, is approximately 1 to 10 mg/m$^2$, preferably 3 to ≡mg/m$^2$.

The surface protection medium, which was to be coated on the surface of the band and which was contained in a pan 8 below the vaporization chamber 4, comprised one part of the sarcosine of oleic acid having a molecular weight of 325 to 355, and one part of the dioctyl sebacate ester of sebacic acid. This mixture had an adequate viscosity of 150 cp (centipoise) at 20° C., and was therefore also adequately finely dispersed and capable of being rapidly deposited on the band.

The band treated in the above described manner had a resistance to corrosion which was 3 to 6 times greater than the resistance of very thin metal sheets not treated in this manner. A considerably increased resistance to corrosion was also established with very thin metal sheets treated with the method of the present invention and packed into units in polyethylene layered paper. Finally, these very thin metal sheets could be varnished at once with commercially available varnish or lacquer on an epoxyphenyl resin base. In this connection, no problems arose either in the course of varnishing or in the adhesion of the varnish.

The advantages of the method of the present invention consist primarily in making available a very thin metal sheet which is suitable for packing purposes, especially for packaging foodstuffs. The very thin metal sheet is also adequately protected against corrosion between the last step of the manufacture of the metal sheet and the first step of further treatment. This corrosion protection can be quickly applied, and the protective surface layer need not be removed prior to varnishing, welding, soldering, or gluing. At the same time, the applied protective layer reduces the rubbing which occurs, for example in treatment lines; that is, the very thin metal sheets are very slidable. Finally, the very thin metal sheets, which are provided with the protective layer in accordance with the present invention, are physiologically harmless, which is especially important for packaging foodstuffs.

The present invention is, of course, in no way limited to the specific showing in the drawing or disclosure of the specification, but also encompasses any modifications within the scope of the appended claims.

What we claim is:

1. A method of electrostatically depositing in a coating apparatus an oil containing corrosion protective surface layer on a very thin metal sheet which is in the form of a band for foodstuff packaging purposes without degreasing for lacquering, welding and printing, which method includes in combination the steps of: moving said band through said apparatus at a high band speed of up to 600m/min; coating said band by electrostatically depositing thereon only a pre-ionized mixture consisting of 1 to 2 parts of an ester of an acid selected from the group consisting of sebacic acid, axelaic acid, and citric acid, and one part of a high molecular acid having the general formula $CH_3\ (CH_2)_n\ CON\ (CH_3)\ CH_2COOH$; and forming said coating by electrostatically depositing in a layer having a uniformly thin though adequate corrosion protective film for periods of transport, storage and processing having a physiologically harmless thickness of only 1 to 10 mg/m$^2$ of surface of said metal sheet.

2. A method in combination according to claim 1, which includes the step of moving said band at a speed of 60 to 360 m/min.

3. A method in combination according to claim 1, in which said ester is selected from the group consisting of dioctyl sebecate and di(2-ethylhexyl) azelate, and said coating includes the sarcosine of eleic acid having a molecular weight of 340 to 350.

4. A method in combination according to claim 1, in which said ester is acetyl tributyl citrate.

5. A method in combination according to claim 1, in which said mixture comprises 1 part of said ester and 1 part of said monobasic acid.

6. A method in combination according to claim 1, in which said layer has a thickness of 3 to 5 mg/m$^2$ of surface of said metal sheet.

7. A method in combination according to claim 1, which includes the step of pre-ionizing said mixture at a voltage of 2 to 20 KV prior to said coating step.

8. A method in combination according to claim 7, which includes the step of pre-ionizing said mixture at 8 to 10 KV.

9. A method in combination according to claim 7, which includes the step of coating said pre-ionized mixture on said band at a voltage of 4 to 40 KV.

10. A method in combination according to claim 9, which includes the step of coating at a voltage of 35 to 40 KV.

11. A method in combination according to claim 1, which includes the step of vaporizing said mixture at a pressure of 0.2 to 0.6 bar.

* * * * *